US006612123B2

(12) United States Patent
Miller, Jr. et al.

(10) Patent No.: US 6,612,123 B2
(45) Date of Patent: Sep. 2, 2003

(54) DUAL PURPOSE PRODUCT MERCHANDISING UNIT

(75) Inventors: Donald J. Miller, Jr., Belleville, IL (US); Maynard Johnson, Ballwin, MO (US)

(73) Assignee: Paul Flum Ideas, Inc., St. Louis, MO (US)

( * ) Notice: Subject to any disclaimer, the term of this patent is extended or adjusted under 35 U.S.C. 154(b) by 0 days.

(21) Appl. No.: 10/036,968

(22) Filed: Dec. 21, 2001

(65) Prior Publication Data

US 2003/0115898 A1 Jun. 26, 2003

(51) Int. Cl.[7] ..... F25D 3/08; A47F 3/04

(52) U.S. Cl. ..... 62/251; 62/457.1; 62/246; 312/128

(58) Field of Search ..... 62/251, 246, 457.1; 312/116, 117, 128

(56) References Cited

U.S. PATENT DOCUMENTS 426,987 A * 4/1890 Lewis ..... D6/479
3,855,943 A * 12/1974 Larson ..... 108/28
4,236,359 A * 12/1980 Woolford ..... 52/66
4,416,380 A * 11/1983 Flum ..... 211/181.1
4,724,682 A 2/1988 Flum et al.
4,890,374 A * 1/1990 Messick, Jr. ..... 29/402.09
5,044,118 A * 9/1991 Ferris ..... 47/41.01
5,048,171 A 9/1991 Bidwell et al.
5,141,105 A * 8/1992 Maye ..... 211/135
5,336,049 A * 8/1994 Herman ..... 416/146 R
5,499,484 A * 3/1996 Herrin ..... 53/458
5,499,513 A * 3/1996 Bustos ..... 62/252
5,553,934 A * 9/1996 Wells et al. ..... 211/59.2
5,669,683 A * 9/1997 Moss et al. ..... 312/259
5,673,511 A * 10/1997 Holtkamp, Jr. ..... 47/18
5,727,857 A * 3/1998 Smith ..... 312/114
D400,030 S * 10/1998 Wetzel ..... D6/474
5,853,235 A * 12/1998 Barnes ..... 312/117
D404,935 S * 2/1999 Shappell ..... D6/472
5,884,499 A * 3/1999 Samborn et al. ..... 312/35
5,910,162 A * 6/1999 Harbour et al. ..... 220/629
6,315,135 B1 * 11/2001 Stuart ..... 211/87.01

FOREIGN PATENT DOCUMENTS

JP 411032841 A * 2/1999 ..... A47B/47/04

* cited by examiner

*Primary Examiner*—William E. Tapolcai
*Assistant Examiner*—Mohammad M. Ali
(74) *Attorney, Agent, or Firm*—Blackwell Sanders Peper Martin LLP

(57) ABSTRACT

A product merchandising unit for holding and displaying multiple and different types of products, the unit including a cooler assembly for holding and displaying chilled products and at least one display rack for holding and displaying periodicals.

39 Claims, 2 Drawing Sheets

DUAL PURPOSE PRODUCT MERCHANDISING UNIT

FIELD OF THE INVENTION

The present invention relates generally to product merchandising units and, more particularly, to a dual purpose product merchandising unit adaptable for displaying at least two different types of products at the same time, for example, chilled beverages and newspapers, magazines, or other periodicals.

BACKGROUND OF INVENTION

Merchandising of products in a retail environment has become both an art and a science and is utilized to achieve increased sales and profits from the sale of a wide variety of different products. The type of product promotion or merchandising campaign chosen to increase sales may be dependent upon the particular type of product being sold, the type of retail store, where the promotion is located in the retail store, where it is positioned relative to eye level, the products it is positioned next to, signage, and so forth. As an example, it is desirable when selling impulse items like a wide variety of different types of periodicals, such as magazines and newspapers, to have such items positioned at the end of aisles or next to the check out counter so that these items may be readily viewed by a consumer who may not be going into the store to specifically buy a periodical. On the other hand, non-impulse items are merchandised differently since consumers specifically go to the store to actively seek them out, for example, soft drink and fruit juice beverages.

Whether or not an item is an impulse item will often times be determined by the type of store in which it is being merchandised and not by the item itself. A cold beverage would likely not be considered an impulse item in a convenience store while in a grocery store the same product might be considered an impulse item. Likewise, in a bookstore, a periodical would not necessarily be an impulse item but in a convenience store, a mass merchandising store, or a grocery store, the periodical would be an impulse item. Thus, depending upon the type of store and the type of customer, the status of a product for sale may change from an impulse item to a non-impulse item and vice versa. If multiple products can be merchandised from the same product merchandising unit, particularly a point-of-purchase display, the potential for cross-selling all products displayed on the single unit is greatly enhanced.

It is also important to note that the availability of floor space in a merchandising environment is always at a premium. As a result, versatility and flexibility in use and mobility are desirable characteristics in any merchandising unit. Since merchandisers know that the strategic location of products for sale can have a great impact on the volume of sales of such products, a merchandising unit which can be easily moved from one location to another within a retail environment, which provides easy accessibility to prospective customers, which provides multiple products to consumers in a limited amount of space, and which can be sized to economize on required floor space is likewise highly desirable. Another desirable characteristic of a product merchandising unit is that it be attractive and that it catch the eye of prospective consumers.

The present product merchandising unit not only satisfies the foregoing needs, but it does so in an inexpensive way by providing an assembly comprised of components that can be easily assembled without special tools to produce a ready to use product merchandising unit which is easily moved from one point of sale location to another, which requires very little floor space and, importantly, which merchandises different types of products in an attractive presentation to potential customers.

Accordingly, the present invention is directed to overcoming one or more of the problems as set forth above.

SUMMARY OF INVENTION

The present invention relates to a product merchandising unit capable of merchandising at least two different types of products at the same time thereby permitting one product to draw a consumer's attention to the other product, for example, merchandising an impulse item along with a non-impulse item. The present merchandising unit includes a support stand having a plurality of upright members with additional display racks carried by the upright members for the display of periodicals such as magazines and newspapers. In one embodiment of the present invention, these additional display racks are comprised of an open grid wire arrangement. Also carried by the support stand and positioned above at least some of the periodical racks is a cooler or container assembly for the display and selection of beverages such as chilled soft drinks, fruit juices, and the like. The cooler assembly is preferably made of a lightweight plastic material and takes the form of a cylindrical tub adaptable for holding a plurality of chilled beverages. The cooler assembly may include a see-through lid member which can be hingedly attached to the cooler assembly for providing easy access to the interior portion of the cooler tub. The clear plastic lid member serves to close the cooler assembly; it provides visibility to the products positioned within the cooler assembly; and it provides ready access to the products by consumers. Lid members of various shapes and styles may likewise be used in conjunction with the present cooler assembly. The cooler assembly may also include an appropriate drainage mechanism for periodically draining waste water from the melted ice which may accumulate within the cooler assembly.

An additional support member is provided to support the cooler assembly on top of the support stand. In one embodiment, this additional support member is cooperatively engagable with the support stand and is likewise cooperatively engagable with the lower portion of the cooler assembly. This additional support member prevents relative movement of the cooler assembly during use and secures the cooler assembly to the support stand. Appropriate casters or other wheel means are also associated with the lower portion of the support stand to provide easy mobility of the overall unit without the need of unloading the entire unit before moving the unit from one location to another.

The present product merchandising unit can readily be assembled by one person from its individual constituent parts. Signage and other indicia may likewise be included on the exterior of the cooler assembly to enhance its appearance and/or to promote the sale of the various products stored therein.

These and other objects and advantageous of the present invention will become apparent to those skilled in the art after considering the following detailed specification in conjunction with the accompanying drawings.

BRIEF DESCRIPTION OF DRAWINGS

For a better understanding of the present invention, reference may be made to the accompanying drawings.

DETAILED DESCRIPTION

For illustrative purposes only, the present product merchandising unit for displaying and merchandising both chilled products and various types of periodicals or other products is described and disclosed with respect to a cylindrically shaped container or cooler assembly. It is anticipated and recognized that the container or cooler assembly may be fashioned in a variety of sizes and shapes including rectangular, square, triangular and other polynomial shapes, and that the other components of the present product merchandising unit may likewise be correspondingly shaped to conform to receiving and/or supporting the shape of the container or cooler assembly without departing from the teachings and practice of the present invention. Although the container assembly is normally used as a cooler to hold and display chilled products, it can also be used to store and display non-chilled products.

Figure 1:
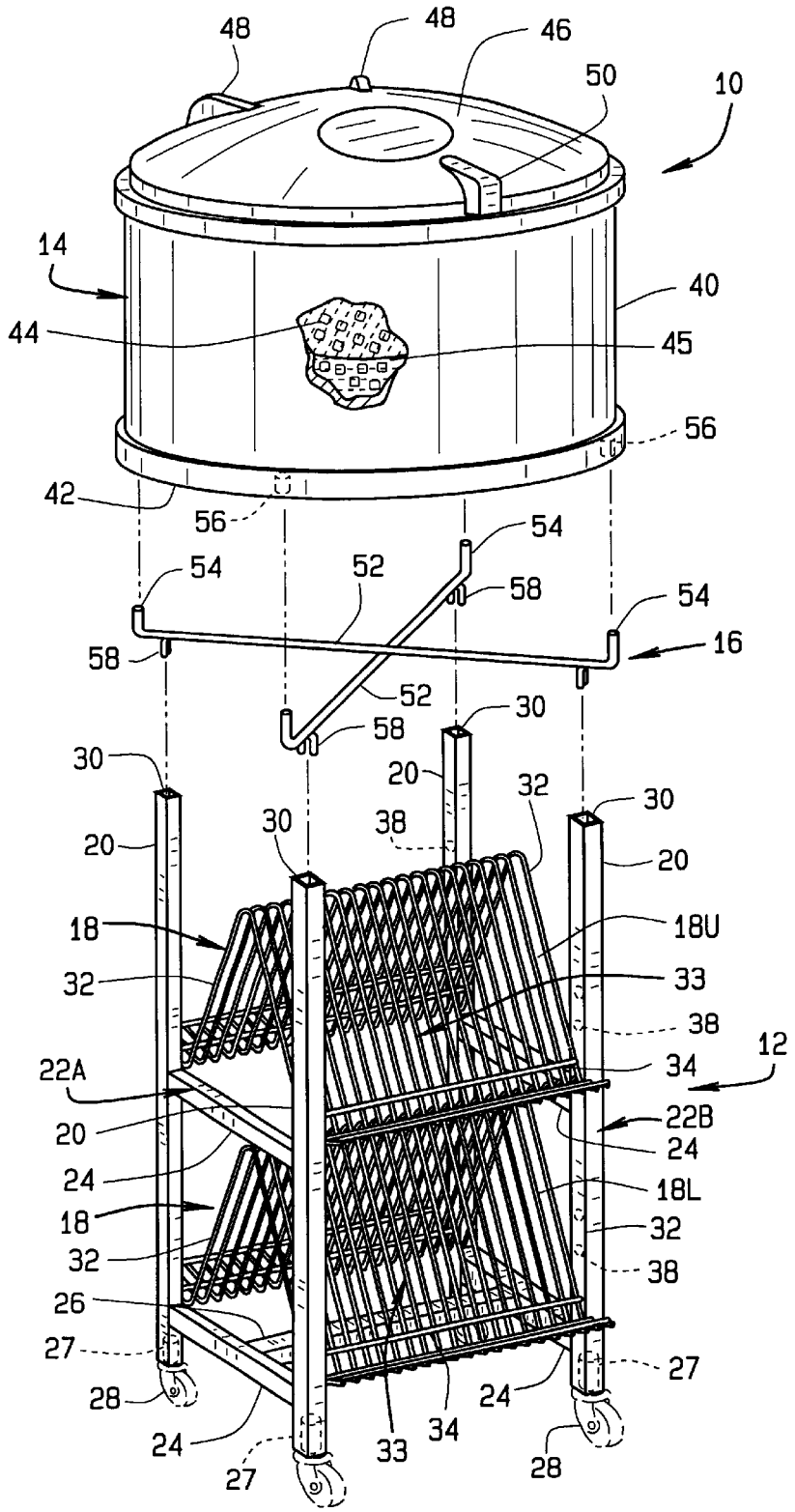
FIG. 1 is an exploded perspective view of a product merchandising unit constructed in accordance with the teachings of the present invention.
Figure 2:
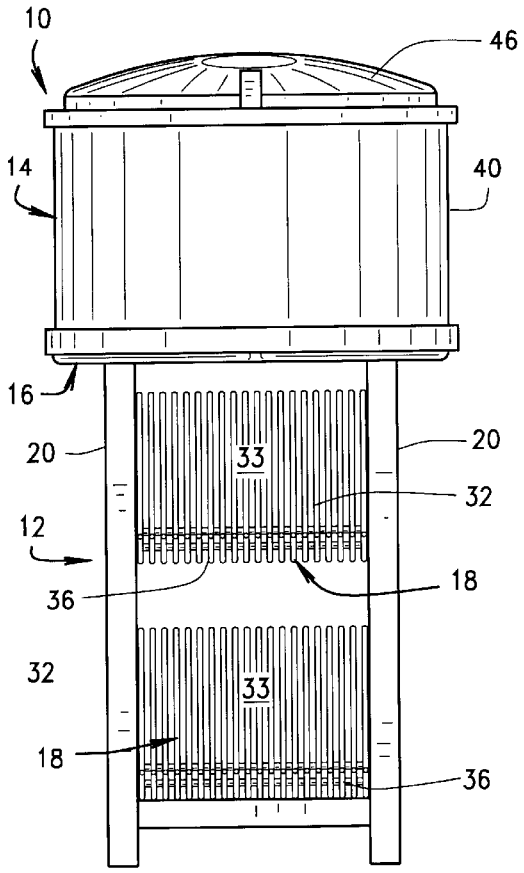
FIG. 2 is a front elevational view of the product merchandising unit of FIG. 1.
Figure 3:
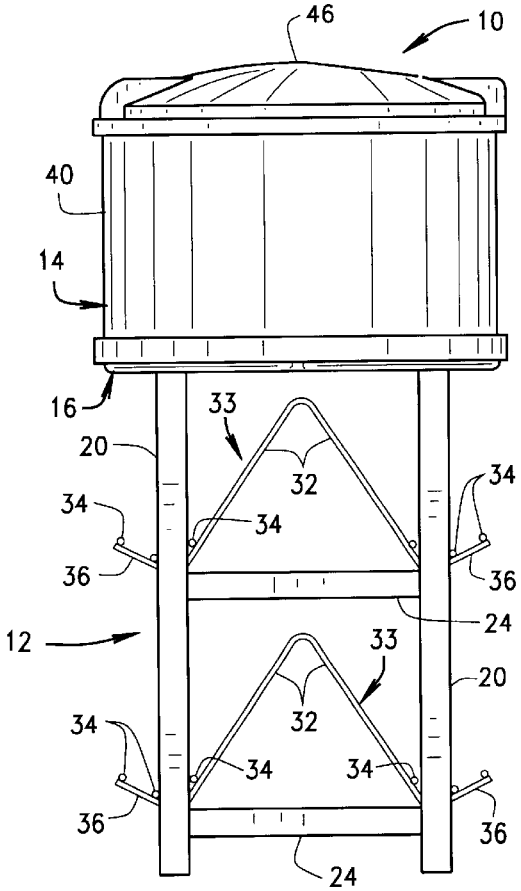
FIG. 3 is a side elevational view of the product merchandising unit of FIG. 1.

Referring to the drawings more particularly by reference numerals wherein like numerals refer to like parts, number 10 in FIGS. 1–3 identifies a dual purpose product merchandising unit constructed according to the teachings of the present invention. The merchandising unit 10 generally includes a support stand 12, a container or cooler assembly 14, a container or cooler support member 16, and at least one additional display rack 18 associated with the support stand 12. When all of the above components are assembled to form the product merchandising unit 10 as illustrated in FIGS. 2 and 3, the result is a merchandising unit that can store and maintain chilled products such as soft drink and fruit juice beverages, either bottles or cans, as well as store and maintain other products such as a wide variety of different types of periodicals for sale to consumers.

The support stand 12 includes a plurality of upright members 20, for example, four such members 20 as illustrated in the embodiment shown in FIG. 1. For stability, it is generally preferred to have at least three upright members 20 or any quantity in excess of three depending upon the particular shape and configuration of the container or cooler assembly 14. In the illustrated embodiment, there are two sets of upright sections 22A and 22B with each section comprising a pair of upright members 20 secured together by at least one cross-brace member 24 forming ladder type sections that are further secured together by at least one transverse cross-brace member 26 extending between the lower most cross members 24. Preferably, the upright members 20 and the cross brace members 24 and 26 are tubular in shape and such members can be joined together by any suitable fastening means. For example, if the support stand 12 is made of a metal material, the members 20, 24 and 26 can be joined together through a welding or other fastening process. If such members are made of a plastic material, such members can be fastened and/or attached to each other using a wide variety of known attachment means including integrally forming such members together during the injection molding or other forming process. Regardless of the type of material used for fabricating members 20, 24 and 26, other suitable means for fastening such members together may likewise be utilized if desired. Also, importantly, upright sections 22A and 22B can be integrally formed into individual one-piece sections, or sections 22A and 22B including all of the members 20, 24, and 26 associated respectively therewith can be integrally formed in their entirety into a one-piece unit.

Each of the upright members 20 preferably includes a downwardly opening socket 27 adaptable for receiving a conventional swivel mounted caster wheel assembly 28. The, caster assembly 28 confers easy mobility to the overall unit 10 without the need of unloading any product from the unit before moving the entire assembly from one location to another. This allows a user to easily position the merchandising unit 10 at any point of purchase merchandising location within a retail environment depending upon the types of products displayed therein. Preferably, at least one of the caster assemblies 28 should be a locking caster assembly to fix the mobility of the unit 10 once it is positioned at the desired location. It is also recognized and anticipated that any wheel means may be utilized to impart the desired mobility to the overall unit 10.

Each upright support member 20 likewise includes an upwardly opening socket 30 adaptable for receiving and fixedly holding the cooler support member 16 as will be hereinafter further described. If the upright support members 20 are tubular in shape, the hollow interior portion of the tubular members 20 can function as the sockets 27 and 30. The tubular sections 22A and 22B as well as members 20, 24, and 26 may be painted, plated or otherwise coded to provide decoration and to enhance the overall appearance of the support stand 12.

The support stand 12 is provided with one or more periodical display racks 18. The display racks 18 are carried by the support stand 12 and are preferably secured to or mounted to the upright members 20. Any conventional means for permanently affixing or removably mounting the display racks 18 to the upright members 20, or to other portions of the support stand 12, may be utilized. In the particular embodiment illustrated in FIG. 1, two display racks 18 are associated with support stand 12, namely, an upper display rack 18U and a lower display rack 18L, although it is recognized and anticipated that any number of display racks 18 may be associated with support stand 12 depending upon the size and shape of the overall merchandising unit 10. In the embodiment illustrated in FIGS. 1–3, the upper and lower display racks 18U and 18L each provide two support surfaces or facings 33 at each level for the display of a wide variety of different types of periodicals for people to view for two different directions or orientations thereby doubling the capacity of the display racks 18. Although utilization of oppositely facing support surfaces 33 in each display rack 18 at each location within support stand 12 increases the merchandising capability of the overall unit, it is also recognized and anticipated that other display rack configurations and facings could likewise be utilized.

In the embodiment illustrated in FIGS. 1–3, the display racks 18 are formed from an open grid of wires or rod members which are bent or otherwise shaped into the configuration best illustrated in FIG. 1. Although it is preferred that each individual display rack 18 be integrally formed as a one-piece unit, it is recognized and anticipated that the particular configuration of display rack 18 illustrated in FIGS. 1–3 can be formed from a plurality of components which are welded together or otherwise attached so as to achieve the illustrated configuration. In this regard, each display rack 18 is comprised of a plurality of generally parallel and spaced wires or rod members 32 which define a support surface or facing 33 and which are joined and held together by a plurality of cross rod members 34. Each facing or support surface 33 associated with each display rack 18 includes an angular foot portion 36 as best illustrated in FIG. 3. The foot portion 36 is appropriately oriented relative to the rod members 32 forming the respective facings 33 so as to hold a plurality of various types of periodicals when positioned thereagainst. In use, one edge portion of a periodical would rest against the foot portion 36 so as to prevent the periodical from sliding off of the display rack 18 whereas one surface of the periodical would lean against and engage the plurality of wires or rod members 32 forming one of the facings or support surface 33 of the display rack 18. The angular orientation of the rod members 32 and the foot portion 36 can be varied depending upon the types of products or periodicals displayed thereon, the specific configuration being chosen so as to effectively display the periodicals or other products to the purchasing public.

The display racks 18 can be mounted or attached to the support stand 12 in any suitable manner as previously explained. In certain situations, it may be advantageous to have the display racks 18 vertically adjustably positionable within the vertical space provided by support stand 12. This can be accomplished by forming a plurality of openings or apertures in the upright members 20 such as the openings 38 located on the inside portion of each of the upright members 20 as best illustrated in FIG. 1 such that the terminal end portions of the cross members 34 can extend and project into the openings 38. The openings 38 may be elongated along the length of each upright member 20 so as to allow tilting of the particular display rack 18 for insertion of the terminal end portions of the cross members 34 into the appropriate elongated openings 38. Also, brackets (not shown) may be secured to the display racks 18 allowing for fastening the same to the upright members 20 via conventional fastening members. Still further, a wide variety of other attachment means may likewise be utilized to adjustably fasten the display racks 18 to the support stand 12.

The container assembly 14 may be any suitable cooler assembly adapted for holding chilled products and will generally include an annular side wall 40 and a bottom wall or base portion 42, both of which combine to define a generally hollow storage area or cavity 44 for holding chilled products such as chilled soft drinks and fruit juice products. The cooler cavity 44 is likewise adaptable for holding ice or other similar pre-cooled coolant 45 and the cooler assembly 14 may likewise include a drain mechanism for conducting the liquid from the melting ice from the cooler cavity 44 to the exterior of the cooler assembly 14. The cooler members 40 and 42 may be made of a one-piece vacuum formed or molded plastic or other suitable material. Lid member 46 is hingedly attached to the upper portion of the annular side wall 40 such as at the locations 48 to provide easy access to the interior cavity 44. The lid member 46 is preferably made of a clear plastic material to enhance the visibility of the chilled products displayed and placed within the cooler cavity 44. The lid member 46 may likewise include a handle member 50 for grasping and lifting the lid member 46 to its opened position, and the lid member 46 may be counterbalanced if necessary so as maintain the member 46 in an erect position when moved to its open position. Although any suitable lid member may be utilized to retain the cold temperature within the cooler cavity 44, the lid member 46 may also be eliminated in certain embodiments to allow an even fuller viewing of the products positioned and stored within the cooler assembly 14. It is also recognized and anticipated that the cooler assembly 14 may take on any suitable size and shape and that the annular side wall 40 and base portion 42 may be adequately insulated to likewise help retain the cold temperature within the cooler cavity 44.

Figure 4:
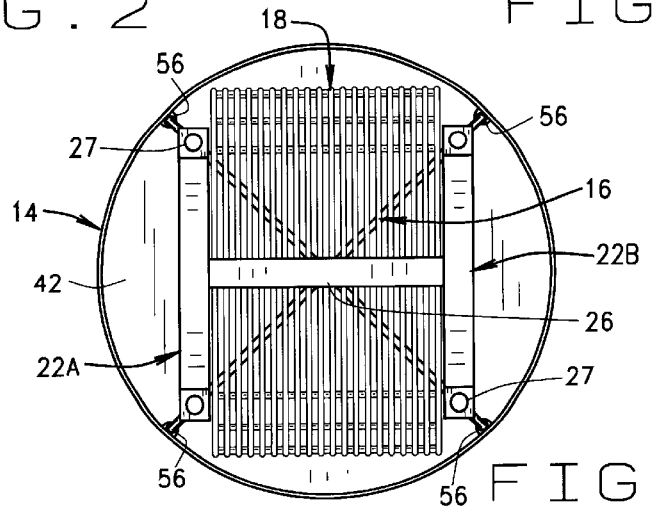
FIG. 4 is a bottom view of the product merchandising unit of FIG. 1.

The bottom wall or base portion 42 of the cooler assembly 14 is adapted to rest upon the support stand 12 so as to be retained at an elevated position for easy viewing by perspective consumers. In one embodiment, this is accomplished through the use of a cooler support member 16 which is provided to not only support the cooler assembly 14, but also to tie together the upper end portions of each of the upright support members 30 so as to prevent their relative movement during use and assembly of the overall unit. In the embodiment illustrated in FIG. 1, cooler support member 16 includes a pair of members 52 which are joined together or otherwise integrally formed into the shape of an X. The members 52 each include an upwardly extending retainer member 54 positioned and located to receive and engage a respective one of a plurality of downwardly extending sockets or openings 56 associated with the bottom wall or base portion 42 of cooler assembly 14 as best illustrated in FIGS. 1 and 4. As illustrated in FIG. 1, each retainer member 54 is associated with a terminal end portion of each of the respective members 52 and such members 54 may be integrally formed with the members 52. When inserted and engaged with the openings 56 associated with the bottom wall or base portion 42 of cooler assembly 14, the upstanding retainer members 54 operate to hold and retain the cooler against lateral movement during use.

The cooler support member 16 also operates to help hold the upright members 20 in alignment during use and functions to provide additional support and stability to the upper portion of the support stand 12. One embodiment of a structure to accomplish this task is the use of the down turned members 58 which are positioned and located for insertion into the upper sockets 30 associated with each respective upright member 20. In the embodiment shown in FIG. 1, the down turned members 58 are each generally U-shaped in configuration, the opposed legs forming the U-shaped configuration forming a snug tight fit within the respective sockets 30. The use of a U-shaped configuration also allows the members 58 to be resiliently deformable or moveable so as to accomplish a satisfactory engagement with the sockets 30 thereby facilitating easy assembly and disassembly. In this regard, it is recognized and anticipated that other configurations of the members 58 may be utilized to accomplish a tight snug fit when engaged with the sockets 30.

The various components which have been described above are easily assembled by one person requiring no special tools. For example, once the cooler support member 16 is engaged with the support stand 12, the cooler assembly 14 is easily positioned and engaged with the upright members 54 to complete the assembly. If the periodical display racks 18 are individually provided for adjustable positioning within the support stand 12, the display racks 18 are engaged with the support stand 12 prior to engaging the cooler support member 16 thereto. The cooler support member 16 ties the cooler assembly 14 to the support stand 12 preventing its lateral movement relative thereto while allowing easy removal of the cooler assembly for cleaning or the like by simply lifting the cooler assembly in a direction generally parallel to the direction of the upwardly extending members 54. It is also recognized and anticipated that the bottom wall or base portion 42 of the cooler assembly 14 can be constructed so as to function as the cooler support member 16. For example, the bottom wall 42 of cooler assembly 14 could include downwardly extending projections (not shown) sized and shaped for engagement with the sockets 30 associated with the upper end portion of each of the upright support members 20. It is also anticipated that the base member 42 may likewise include sockets (not shown) adaptable for receiving the upper end portion of each of the upright support members 20. Still other means associated with the bottom wall or base portion 42 of the cooler assembly 14 is envisioned and can be utilized to securely engage the cooler assembly 14 with the support stand 12.

Once the cooler assembly 14 and the periodical display racks 18 are assembled or otherwise attached to the support stand 12, the present product merchandising unit 10 serves a dual purpose in that the merchandising unit 10 is capable of displaying and merchandising two substantially different types of products to potential consumers, namely chilled beverages and a wide variety of different types of periodicals including newspapers and magazines. This dual capability greatly increases the usefulness and effectiveness of the unit 10 and likewise greatly enhances and promotes point-of-purchase sales. It is also recognized that the present unit 10 can be utilized to merchandise all impulse type products, all non-impulse type products and/or a combination of impulse and non-impulse type products, depending upon the particular merchandising environment and the needs of the user.

Although the present cooler assembly 14 has been described in conjunction with the chilling, storage and display of soft drink type beverages including fruit juices, it can likewise be used for chilling, storage and displaying other articles of merchandise such as milk, beer, dairy products and the like. It can likewise be used for storing and displaying non-chilled products including products other than beverages. Also, color and artistic designs may be easily incorporated on the cooler assembly 14 for enhancing the beauty and appearance of the overall assembly and/or for promoting and advertising the particular chilled articles and periodicals associated with the merchandising unit 10. In addition, as previously mentioned, it is also recognized that the cooler assembly 14 and all of the other components of the present device including the support stand 12, the cooler support member 16 and the display racks 18 may be conveniently fashioned into a variety of sizes and configurations other than the particular configurations illustrated in FIG. 1 without impairing the teachings and practice of the present invention.

Thus, there has been shown and described a novel dual purpose product merchandising display unit for use in displaying and merchandising at least two different types of products at the same time including chilled products, which product merchandising unit fulfills all of the objects and advantages sought therefor. Many changes, modifications, variations and other uses and applications of the present unit will, however, become apparent to those skilled in the art after considering this specification and the accompanying drawings. All such changes, modifications, variations, and other uses and applications which do not depart from the spirit and scope of the present invention are deemed to be covered by the invention which is limited only by the claims which follow.

What is claimed is:

1. A product merchandising unit adaptable for holding and displaying at least two different products comprising:

a support stand;

at least one display rack associated with said support stand said display rack being adaptable for holding and displaying at least a first product; and a container assembly adaptable for holding and displaying at least a second product, said container assembly being supported by and attached to the support stand and being positioned above said at least one display rack, said container assembly having at least a bottom wall and a side wall at least partially defining a second product storage cavity and an opening associated therewith for allowing access to the at least second produce therein, said cavity being adaptable for holding pre-cooled coolant in at least one of frozen or liquid form.

2. The product merchandising unit as set forth in claim 1 wherein said support stand includes a plurality of upright support members, said at least one display rack being fixedly secured to at least some of said upright support members.

3. The product merchandising unit as set forth in claim 1 wherein said support stand includes a plurality of upright support members, said at least one display rack being adjustably mountable to at least some of said upright support members.

4. The product merchandising unit as set forth in claim 1 wherein said support stand includes a plurality of upright support members, said container assembly being supported by said plurality of upright support members.

5. The product merchandising unit as set forth in claim 4 wherein at least one end portion of each of said plurality of upright support members including a socket, said container assembly including a plurality of projections adaptable for being insertably received within at least some of the sockets associated with said plurality of upright support members.

6. The product merchandising unit as set forth in claim 4 wherein said container assembly includes a plurality of sockets, at least some of said plurality of upright support members being cooperatively engagable with the sockets associated with said container assembly.

7. The product merchandising unit as set forth in claim 1 including a support member engagable with said support stand, said support member being likewise engagable with said container assembly for holding and supporting said container assembly in a position above said at least one display rack.

8. The product merchandising unit as set forth in claim 1 wherein said at least one display rack is adaptable for holding and displaying periodicals, and wherein said container assembly is adaptable for holding and displaying chilled products.

9. The product merchandising unit as set forth in claim 1 including at least one additional display rack associated with said support stand, said at least one additional display rack being adaptable for holding and displaying additional products.

10. The product merchandising unit as set forth in claim 1 wherein said at least one display rack is of an open grid wire construction.

11. The product merchandising unit as set forth in claim 1 wherein said at least one display rack includes two separate support surfaces for holding and displaying said at least first product, said separate display rack support surfaces allowing said at least first product to be viewed from two different directions.

12. The product merchandising unit as set forth in claim 1 wherein said container assembly includes a lid member, said lid member being pivotally attached to said container assembly.

13. The product merchandising unit as set forth in claim 1 wherein said container assembly is cylindrical in shape.

14. The product merchandising unit as set forth in claim 1 wherein said support stand includes wheel means for moving said product merchandising unit from one location to another.

15. A product merchandising unit adaptable for holding and displaying both chilled and non-chilled products simultaneously, said product merchandising unit comprising:

a support stand having a plurality of upright support members associated therewith;

at least one display rack associated with said support stand, said display rack being adaptable for holding and displaying non-chilled products and being attached to at least some of said upright support members; and a cooler assembly adaptable for holding and displaying chilled products, said cooler assembly being positioned above said at least one display rack and being both supported by at least some of said plurality of upright support members and attached to said support stand, said cooler assembly having at least a bottom wall and side wall at least partially defining a chilled product storage cavity, said cavity being adaptable for holding pre-cooled coolant in at least one of frozen or liquid form.

16. The product merchandising unit as set forth in claim 15 wherein said at least one display rack is adjustably mountable to at least some of said upright support members.

17. The product merchandising unit as set forth in claim 15 including a plurality of display racks associated with said support stand and mountable to at least some of said upright support members.

18. The product merchandising unit as set forth in claim 15 including a cooler support member for holding and supporting said cooler assembly above said at least one display rack, said cooler support member being engagable with at least some of said upright support members and with said cooler assembly for preventing lateral movement of said cooler assembly when engaged therewith.

19. The product merchandising unit as set forth in claim 18 wherein said cooler support member includes a plurality of downwardly extending members and at least some of said upright support members include a socket, said plurality of downwardly extending members being engagable with the sockets associated with at least some of the upright support members.

20. The product merchandising unit as set forth in claim 18 wherein said cooler support member includes a plurality of upwardly extending members and said cooler assembly includes a plurality of sockets, said plurality of upwardly extending members being engagable with the sockets associated with said cooler assembly.

21. The product merchandising unit as set forth in claim 15 wherein said support stand includes wheel means for moving said product merchandising unit from one location to another.

22. The product merchandising unit as set forth in claim 15 wherein said at least one display rack is adaptable for holding periodicals.

23. The product merchandising unit as set forth in claim 15 wherein said cooler assembly includes a lid member pivotally attached thereto.

24. The product merchandising unit as set forth in claim 19 wherein the cooler support member includes a pair of members each having opposite ends, said pair of members being secured together at a location between said opposite ends, said downwardly extending members being each respectively fixed to said pair of members at locations enabling engagement with the sockets associated with at least some of the upright support members.

25. The product merchandising unit as set forth in claim 20 wherein the cooler support member includes a pair of members each having opposite ends, said pair of members being secured together at a location between said opposite ends, said upwardly extending members being each respectively fixed to a respective opposite end of said pair of members.

26. The product merchandising unit as set forth in claim 18 wherein the cooler support member includes a pair of first members each having opposite ends, said pair of first members being secured together at a location between said opposite ends, said cooler member further including a plurality of second members engagable with each of said upright support members and a plurality of third members engagable with said cooler assembly, said second and third members being fixedly secured to said pair of first members.

27. A freestanding product merchandising unit adaptable for holding chilled products and periodicals comprising:

a support stand having a plurality of upright support numbers associated therewith;

a plurality of display racks adaptable for holding and displaying periodicals, said display racks being attached to said support stand;

a cooler assembly adaptable for holding and displaying chilled products, said cooler assembly being positioned above said plurality of display rack and attached to the support stand, said cooler assembly having at least a bottom wall and a side wall at least partially defining a chilled product storage cavity, said cavity being adaptable for holding pre-cooled coolant in at least one of frozen or liquid form; and a cooler support member, said cooler support member being engageable with said upright support members and with said cooler assembly for attaching said cooler assembly to said support stand.

28. The product merchandising unit as set forth in claim 27 wherein each of said plurality of upright support members includes a socket, and wherein said cooler support member includes a plurality of members engagable with each of said upright support member sockets.

29. The product merchandising unit as set forth in claim 27 wherein said cooler assembly includes a plurality of sockets, and wherein said cooler support member includes a plurality of members engagable with said cooler assembly sockets.

30. The product merchandising unit as set forth in claim 27 wherein at least one of said plurality of display racks is vertically adjustably attachable to said support stand.

31. The product merchandising unit as set forth in claim 27 wherein said support stand includes wheel means for moving said product merchandising unit from one location to another.

32. The product merchandising unit as set forth in claim 27 wherein said cooler assembly includes a lid member pivotally attached thereto.

33. The product merchandising unit as set forth in claim 27 wherein said cooler assembly is cylindrical in shape.

34. The product merchandising unit as set forth in claim 27 wherein said plurality of display racks are integrally formed with said support stand.

35. The product merchandising unit as set forth in claim 27 wherein each of said plurality of upright support members includes a socket and wherein said cooler assembly includes a plurality of sockets, said cooler support member including a pair of first members each having opposite ends, said pair of first members being secured together at a location between said opposite ends, said cooler support member further including a plurality of second member fixedly secured to said pair of first members, said plurality of second members being each respectively engagable with a socket associated with said upright support members, said cooler support member further including a plurality of third members each respectively fixedly secured to a respective opposite end of said pair of first members, each of said plurality of third members being respectively engagable with a socket associated with said cooler assembly.

36. A product merchandising unit adaptable for holding and displaying both chilled and non-chilled products simultaneously, said product merchandising unit comprising:

a support stand having a plurality of upright support members associated therewith;

at least one display rack associated with said support stand, said display rack being adaptable for holding and displaying non-chilled products and being attached to at least some of said upright support members;

a cooler assembly adaptable for holding and displaying chilled products, said cooler assembly being positioned above said at least one display rack and being both supported by at least some of said plurality of upright support members and attached to said support stand, said cooler assembly having at least a bottom wall and a side wall at least partially defining a chilled product storage cavity; and a cooler support member for holding and supporting said cooler assembly above said at least one display rack, said cooler support member being engageable with at least some of said upright support members and with said cooler assembly for preventing lateral movement of said cooler assembly when engaged therewith and including a pair of members each having opposite ends, said pair of members being secured together at a location between said opposite ends, said cooler support member further including a plurality of upwardly extending members and said cooler assembly fisher including a plurality of sockets, said plurality of upwardly extending members being each respectively fixed to a respective opposite end of said pair of members and being engageable with the sockets associated with said cooler assembly.

37. A product merchandising unit adaptable for holding and displaying both chilled and non-chilled products simultaneously, said product merchandising unit comprising:

a support stand having a plurality of upright support members associated therewith;

at least one display rack associated with said support stand, said display rack being adaptable for holding and displaying non-chilled products and being attached to at least some of said upright support members;

a cooler assembly adaptable for holding and displaying chilled products, said cooler assembly being positioned above said at least one display rack and being both supported by at least some of said plurality of upright support members and attached to said support stand, said cooler assembly having at least a bottom wall and a side wall at least partially defining a chilled product storage cavity, and a cooler support member for holding and supporting said cooler assembly above said at least one display rack, said cooler support member being engageable with at least some of said upright support members and with said cooler assembly for preventing lateral movement of said cooler assembly when engaged therewith and including a pair of members each having opposite ends, said pair of members being secured together at a location between said opposite ends, said cooler support member further including a plurality of downwardly extending members and at least some of said upright support members further including a socket, said plurality of downwardly extending members being each respectively fixed to said pair of members at locations enabling engagement with the sockets associated with at least some of the upright support members.

38. A product merchandising unit adaptable for holding and displaying both chilled and non-chilled products simultaneously, said product merchandising unit comprising:

a support stand having a plurality of upright support members associated therewith;

at least one display rack associated with said support stand, said display rack being adaptable for holding and displaying non-chilled products and being attached to at least some of said upright support members;

a cooler assembly adaptable for holding and displaying chilled products, said cooler assembly being positioned above said at least one display rack and being both supported by at least some of said plurality of upright support members and attached to said support stand, said cooler assembly having at least a bottom wall and a side wall at least partially defining a chilled product storage cavity; and a cooler support member for holding and supporting said cooler assembly above said at least one display rack, said cooler support member being engageble with at least some of said upright support members and with said cooler assembly for preventing lateral movement of said cooler assembly when engaged therewith, said cooler support member including a pair of first members each having opposite ends, said pair of first members being secured together at a location between said opposite ends, said cooler member further including a plurality of second members engagable with at least some of said upright support members and a plurality of third members engagable with said cooler assembly, said second and third members being fixedly secured to said pair of first members.

39. A freestanding product merchandising unit adaptable for holding chilled products and periodicals comprising:

a support stand having a plurality of upright support members associated therewith;

a plurality of display racks adaptable for holding and displaying periodicals, said display racks being attached to said support stand;

a cooler assembly adaptable for holding and displaying chilled products, said cooler assembly being positioned above said plurality of display racks and attached to the support stand, said cooler assembly having at least a bottom wall and a side wall at least partially defining a chilled product storage cavity; and a cooler support member, said cooler support member being engagable with said upright support members and with said cooler assembly for attaching said cooler assembly to said support stand, each of said plurality of upright support members including a socket and said cooler assembly including a plurality of sockets, said cooler support member including a pair of first members each having opposite ends, said pair of first members being secured together at a location between said opposite ends, said cooler support member further including a plurality of second members fixedly secured to said pair of first members, said plurality of second members being each respectively engagable with a socket associated with said upright support members, said cooler support member further including a plurality of third members each respectively fixedly secured to a respective opposite end of said pair of first members each of said plurality of third members being respectively engageable with a socket associated with said cooler assembly.

* * * * *

UNITED STATES PATENT AND TRADEMARK OFFICE

CERTIFICATE OF CORRECTION

PATENT NO. : 6,612,123 B2
DATED : September 2, 2003
INVENTOR(S) : Donald J. Miller, Jr. et al.

It is certified that error appears in the above-identified patent and that said Letters Patent is hereby corrected as shown below:

Column 8,
Line 6, delete "produce" and replace with -- product --;

Column 9,
Line 17, prior to the phrase "*side wall*", insert -- a --;

Column 10,
Line 18, delete "numbers" and replace with -- members --;
Line 24, delete "rack" and replace with -- racks --;

Column 11,
Line 37, delete "fisher" and replace with -- further --.

Signed and Sealed this

Sixth Day of January, 2004

JAMES E. ROGAN
*Director of the United States Patent and Trademark Office*